US005440495A

United States Patent [19]

Sainen et al.

[11] Patent Number: 5,440,495

[45] Date of Patent: Aug. 8, 1995

[54] CONTROL DEVICE FOR WEFT INSERTING IN JET LOOM

[75] Inventors: Tsutomu Sainen; Shigeo Yamada, both of Ishikawa, Japan

[73] Assignee: Tsudakoma Kogyo Kabushiki Kaisha, Ishikawa, Japan

[21] Appl. No.: 843,546

[22] Filed: Feb. 28, 1992

[30] Foreign Application Priority Data

Mar. 8, 1991 [JP] Japan ..... 3-067684

[51] Int. Cl.[6] ..... G06F 15/46

[52] U.S. Cl. ..... 364/470; 139/435.1; 395/900; 395/904

[58] Field of Search ..... 364/470, 148, 166; 395/61, 902, 903, 904, 906, 900; 139/435.2, 1 C, 11, 116.2, 452, 429, 336, 450, 370.2, 435.1, 105

[56] References Cited

U.S. PATENT DOCUMENTS

| | | | |
|---|---|---|---|
| 4,020,877 | 5/1977 | Spisiak et al. | 139/435.2 |
| 4,245,677 | 1/1981 | Suzuki et al. | 139/435.1 |
| 4,262,707 | 4/1981 | Suzuki | 139/435.1 |
| 4,716,941 | 1/1988 | Takegawa | 139/435.2 |
| 4,759,392 | 7/1988 | van Bogaert et al. | 139/435.2 |
| 4,932,442 | 6/1990 | Ishido et al. | 139/435.2 |
| 4,967,806 | 11/1990 | Imamura et al. | 139/435.1 |
| 5,067,527 | 11/1991 | de Jager | 139/435.2 |
| 5,134,568 | 7/1992 | Sainen | 364/470 |
| 5,155,691 | 10/1992 | Sainen | 364/470 |

FOREIGN PATENT DOCUMENTS

| | | |
|---|---|---|
| 0241286 | 10/1987 | European Pat. Off. . |
| 0382490 | 8/1990 | European Pat. Off. . |
| 0403175 | 12/1990 | European Pat. Off. . |
| 0414211 | 2/1991 | European Pat. Off. . |
| 63-182448 | 7/1988 | Japan . |

*Primary Examiner*—Jerry Smith
*Assistant Examiner*—Jim Trammell
*Attorney, Agent, or Firm*—Graybeal Jackson Haley & Johnson

[57] ABSTRACT

A control device for weft inserting in a jet loom realizes weft inserting in stable running conditions without depending on the professional perceptions and experiences of operators. The control device for weft inserting is constructed by inferring a corrected value of at least one parameter for weft inserting by fuzzy inference on the basis of at least one operating information relating to the weft inserting in a weaving machine in order to accept an operating condition of the weaving machine at an objective value, and controlling at least one actuator for weft inserting on the basis of the corrected value inferred by the fuzzy inference.

11 Claims, 10 Drawing Sheets

FIG. 3

CONTROL PARAMETERS :

UPPER COLUMN ····· MAIN PRESSURE
LOWER COLUMN ····· SUBPRESSURE

| | | RELEASED AVERAGE | | | RELEASED DISPERSION | | | ARRIVAL AVERAGE | | | ARRIVAL DISPERSION | | |
|---|---|---|---|---|---|---|---|---|---|---|---|---|---|
| | | SLOW | 0 | FAST | LARGE | MEDIUM | SMALL | SLOW | 0 | FAST | LARGE | MEDIUM | SMALL |
| RELEASED AVERAGE | SLOW | | | | R8:PS | | R11:PS | R13:PB | | R15:PS | | | |
| | | | | | | | | ZE | | NB | | | |
| | 0 | | | | R9:PS | | | R14:ZE | | R16:NB | | | |
| | | | | | | | | | | | | | |
| | FAST | | | | R10:PS | | R12:NS | | | | | | |
| | | | | | | | | R17:PB | | | | | |
| RELEASED DISPERSION | LARGE | | | | R2:PS | | | | | | | | |
| | | | | | | | | | | | | | |
| | MED | | | | | | | | | | | | |
| | | | | | | | | | | | | | |
| | SMALL | | | | | | | | | R3:NS | | | |
| | | | | | | | | | | | R18:PB | | |
| ARRIVAL AVERAGE | SLOW | | | | | | | R1:PS | | | R4:PB | | R6:PS |
| | | | | | | | | PS | | | PB | | PS |
| | 0 | | | | | | | | | | | | |
| | | | | | | | | | R19:ZE | | | | |
| | FAST | | | | | | | | | | R5:ZE | | R7:NB |
| | | | | | | | | | | R20:NS | PS | | |
| ARRIVAL DISPERSION | LARGE | | | | | | | | | | | | |
| | | | | | | | | | | | R21:PS | | |
| | MED | | | | | | | | | | | | |
| | | | | | | | | | | | | R22:ZE | |
| | SMALL | | | | | | | | | | | | |
| | | | | | | | | | | | | | R23:NS |

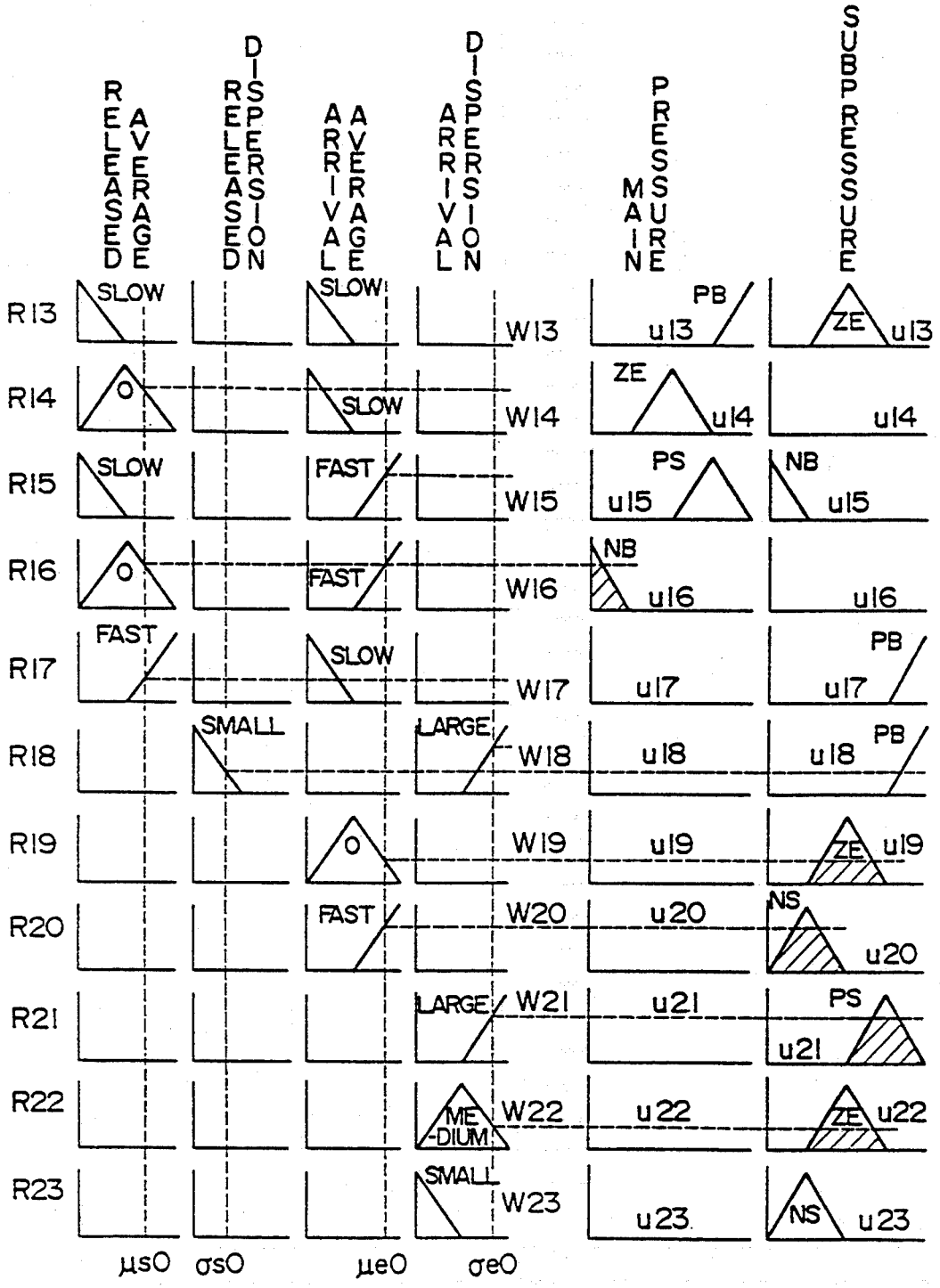
FIG. 6
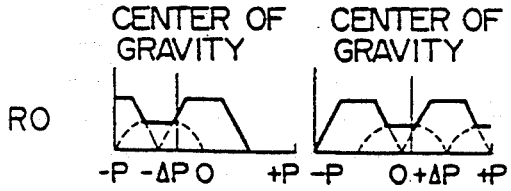

FIG. 9

| | FABLIC QUALITY INFORMATION | | | WEAVING MACHINE STOP INFORMATION | | | | WEFT RUNNING INFORMATION | | | MAIN PRESSURE | SUB-PRESSURE |
|---|---|---|---|---|---|---|---|---|---|---|---|---|
| | WEFT LOOSE-NESS | KINKY THREAD | WEAVING FEATHER | WASTE OF TOP ENDS | TIE-UP OF TOP ENDS | BLOW-OFF OF TOP ENDS | NON-CON-STRAINT | ARRIVAL ANGLE | STAND-ARD DEVIATION | RE-LEASED VELOCITY | | |
| R3·1 | LOT | | | | | | | | | | INCREASE | INCREASE |
| R3·2 | LITTLE | | | | | | | | | | NOT CHANGE | NOT CHANGE |
| R3·3 | | LOT | | | | | | | | | INCREASE | INCREASE |
| R3·4 | | LITTLE | | | | | | | | | NOT CHANGE | NOT CHANGE |
| R3·5 | | | LOT | | | | | | | | DECREASE | DECREASE |
| R3·6 | | | LITTLE | | | | | | | | NOT CHANGE | NOT CHANGE |
| R3·7 | LOT | | | | LOT | | | | | | INCREASE A LITTLE | INCREASE |
| R3·8 | LOT | | | | LITTLE | | | | | | INCREASE | INCREASE A LITTLE |
| R3·9 | LITTLE | | | | LOT | | | | | | DECREASE A LITTLE | NOT CHANGE |
| R3·10 | LITTLE | | | | LITTLE | | | | | | NOT CHANGE | NOT CHANGE |
| R3·11 | LOT | | | | | LOT | | | | | DECREASE A LITTLE | DECREASE A LITTLE |
| R3·12 | LOT | | | | | LITTLE | | | | | INCREASE A LITTLE | INCREASE A LITTLE |
| R3·13 | LITTLE | | | | | LOT | | | | | DECREASE | DECREASE A LITTLE |
| R3·14 | LITTLE | | | | | LITTLE | | | | | NOT CHANGE | NOT CHANGE |

FIG. 10

| | FABLIC QUALITY INFORMATION | | | WEAVING MACHINE STOP INFORMATION | | | | WEFT RUNNING INFORMATION | | | MAIN PRESSURE | SUB-PRESSURE |
|---|---|---|---|---|---|---|---|---|---|---|---|---|
| | WEFT LOOSE-NESS | KINKY THREAD | WEAVING FEATHER | WASTE OF TOP ENDS | TIE-UP OF TOP ENDS | BLOW-OFF OF TOP ENDS | NON-CON-STRAINT | ARRIVAL ANGLE | STAND-ARD DEVIATION | RE-LEASED VELOCITY | | |
| R3·15 | LOT | | | | | | LOT | | | | INCREASE A LITTLE | DECREASE A LITTLE |
| R3·16 | LOT | | | | | | LITTLE | | | | INCREASE A LITTLE | NOT CHANGE |
| R3·17 | LITTLE | | | | | | LOT | | | | DECREASE A LITTLE | DECREASE A LITTLE |
| R3·18 | LITTLE | | | | | | LITTLE | | | | NOT CHANGE | NOT CHANGE |
| R3·19 | | LOT | | | LOT | | | | | | INCREASE A LITTLE | INCREASE A LITTLE |
| R3·20 | | LOT | | | LITTLE | | | | | | INCREASE A LITTLE | INCREASE A LITTLE |
| R3·21 | | LITTLE | | | LOT | | | | | | DECREASE A LITTLE | NOT CHANGE |
| R3·22 | | LITTLE | | | LITTLE | | | | | | NOT CHANGE | NOT CHANGE |
| R3·23 | | LOT | | | | LOT | | | | | DECREASE A LITTLE | DECREASE A LITTLE |
| R3·24 | | LOT | | | | LITTLE | | | | | INCREASE A LITTLE | INCREASE A LITTLE |
| R3·25 | | LITTLE | | | | LOT | | | | | DECREASE | DECREASE A LITTLE |
| R3·26 | | LITTLE | | | | LITTLE | | | | | NOT CHANGE | NOT CHANGE |
| R3·27 | | LOT | | | | | LOT | | | | INCREASE A LITTLE | DECREASE A LITTLE |
| R3·28 | | LOT | | | | | LITTLE | | | | INCREASE A LITTLE | NOT CHANGE |

FIG. 11

| | FABLIC QUALITY INFORMATION | | | WEAVING MACHINE STOP INFORMATION | | | | WEFT RUNNING INFORMATION | | | MAIN PRESSURE | SUB-PRESSURE |
|---|---|---|---|---|---|---|---|---|---|---|---|---|
| | WEFT LOOSE-NESS | KINKY THREAD | WEAVING FEATHER | WASTE OF TOP ENDS | TIE-UP OF TOP ENDS | BLOW-OFF OF TOP ENDS | NON-CON-STRAINT | ARRIVAL ANGLE | STAND-ARD DEVIATION | RE-LEASED VELOCITY | | |
| R3·29 | | LITTLE | | | | | LOT | | | | DECREASE A LITTLE | DECREASE A LITTLE |
| R3·30 | | LITTLE | | | | | LITTLE | | | | NOT CHANGE | NOT CHANGE |
| R3·31 | | | LOT | LOT | | | | | LARGE | | DECREASE A LITTLE | DECREASE A LITTLE |
| R3·32 | | | LOT | LOT | | | | | SMALL | | DECREASE A LITTLE | NOT CHANGE |
| R3·33 | | | LITTLE | LOT | | | | | LARGE | | DECREASE A LITTLE | NOT CHANGE |
| R3·34 | | | LITTLE | LOT | | | | | SMALL | | INCREASE A LITTLE | INCREASE A LITTLE |
| R3·35 | | | | | | | | SLOW | LARGE | SLOW | INCREASE A LITTLE | INCREASE A LITTLE |
| R3·36 | | | | | | | | SLOW | LARGE | FAST | NOT CHANGE | INCREASE A LITTLE |
| R3·37 | | | | | | | | SLOW | SMALL | SLOW | INCREASE A LITTLE | NOT CHANGE |
| R3·38 | | | | | | | | SLOW | SMALL | FAST | INCREASE A LITTLE | INCREASE A LITTLE |
| R3·38 | | | | | | | | FAST | LARGE | | NOT CHANGE | INCREASE A LITTLE |
| R3·39 | | | | | | | | FAST | SMALL | | DECREASE A LITTLE | NOT CHANGE |

CONTROL DEVICE FOR WEFT INSERTING IN JET LOOM

BACKGROUND OF THE INVENTION

1. Field of the Invention

This invention relates to a device for controlling weft inserting in an air jet loom and a water jet loom or the like, and more particularly to a control device for weft inserting in a jet loom provided with an actuator for controlling the weft inserting.

2. Description of the Prior Art

In a jet loom, it is desired to control weft inserting so that a weft running condition, in particular, an arrival timing such as the angle of rotation (arrival angle) of a main shaft when a weft arrives at a predetermined position may become constant, in other words, so that the weft may be inserted in a predetermined running condition.

For this reason, in the jet loom, there has been proposed a technique which corrects at least one parameter selected from the pressure (designated as a "main pressure" in the present invention) of a fluid ejected from a main nozzle and the pressure (designated as a "subpressure" in the present invention) of a fluid ejected from a subnozzle or the like and controls an actuator thereof in order to correct at least one running data selected from the average value of arrival timing and the dispersion of arrival timing or the like.

However, in the jet loom, there are the cases where a direction for controlling one parameter so as to correct one running data to a predetermined value agrees or does not agree with a direction for controlling the above-mentioned one parameter so as to correct the other one running data to a predetermined value, that is, the case where such directions become reverse to each other. Therefore, an exactly corrected value, that is, a controlled variable cannot be determined.

In case where the control directions of one parameter by two running data are same with each other, this becomes the case of a control system of one output against two inputs (multiple inputs). Therefore, even though the parameter may be controlled by the value resulting from merely adding the controlled variables obtained every running data or the average value of the controlled variables obtained every the running data, both of two running data are not always attained within the range of objective values, and therefore, the controlled variables thus obtained cannot be always correct.

For example, in case of trying to simultaneously control a main pressure by both of the average value and the dispersion of arrival timing, this becomes similarly the case of a control system of one output (main output) against two inputs (average value and dispersion). Therefore, there are some cases where the control directions of outputs are opposite to each other depending on the combination of both input signals.

Namely, when the average value is rapid and the dispersion is large, the main pressure must be lessened since the average value is rapid. On the other hand, the main pressure must be increased since the dispersion is large. Thus, any correct controlled variables cannot be determined since the control directions of the outputs are opposite to each other.

As a result, there are no helps but largely depending on the professional perceptions and experiences of operators, and the control of weft inserting described above could not be automated.

SUMMARY OF THE INVENTION

Accordingly, an object of the present invention is to make it possible to do weft inserting in a stable running condition without depending on the professional perceptions and experiences of operators.

A control device for weft inserting in a jet loom according to the present invention comprises means for outputting at least one operating information relating to the weft inserting of a weaving machine, and means for inferring a corrected value of at least one parameter for weft inserting by fuzzy inference on the basis of the operating information so as to make an operating condition of the weaving machine such as an average or dispersion of above-mentioned timing a fabric quality or the like attained at an objective value and controlling at least one actuator for weft inserting on the basis of the corrected value thus inferred.

Weft running information representing a weft running condition, weaving machine stop information representing a weaving machine stopping condition and fabric quality information representing a fabric quality condition or the like can be used as the operating information called in the present invention, and an arbitrary combination of these information can be also used. These operating information will be described in detail later.

According to the present invention, the corrected value described above can be obtained by fuzzy inference which gives fuzzy set using a plurality of membership functions and a plurality of fuzzy control rules. For this reason, the right corrected values can be obtained and the weft running condition is stabilized by the present invention without depending on any professional perceptions and experiences of operators.

It is preferable to use a plurality of operating information for the fuzzy inference. Even in this case, a right corrected value can be obtained and the weft running condition can be stabilized without depending on any professional perceptions and experiences of the operators, even though the control directions due to these operating information may be same or opposite to each other.

According to another aspect of the present invention, a control device for weft inserting in a jet loom comprises signal generation means for detecting a weft and generating an electric signal corresponding to the timing at that time, calculation means for calculating the statistics of the average value and dispersion of the timing on the basis of the output signal of the signal generation means, and control means for inferring a corrected value of at least one parameter for weft inserting by fuzzy inference on the basis of the statistics calculated by the calculation means so as to make an operating condition of the weaving machine such as an average or dispersion of the above-mentioned timing, a fabric quality or the like attained at objective values and then controlling at least one actuator for weft inserting on the basis of the corrected value thus inferred.

When the weft is detected, the signal generation means supplies an electric signal corresponding to such a timing (namely, weft running timing) as the angle of a main shaft at the weft detection time to the calculation means every one or several picks, and the calculation means calculates the average value and dispersion of timing and supply such average value and dispersion to the control means. In this way, the control means infers the corrected value of the parameter used in weft inserting by fuzzy inference on the basis of the supplied average value and dispersion, and controls the actuator for weft inserting on the basis of the corrected value thus inferred.

For this reason, according to the present invention, the corrected value of the parameter in common, that is, the controlled variable is obtained using the average value and dispersion of weft running timing which could not be done, and the actuator can be controlled on the basis of the corrected value thus obtained. Therefore, both of the average value and dispersion of weft running timing can do a stable weft inserting.

As the weft running timing, it can be either of one or a combination of so-called "released timing" that the weft is released from a measuring reservoir apparatus and so-called "arrival timing" that the weft arrives at a predetermined position.

As the released timing, if the measuring reservoir apparatus has a reservoir drum, use may be made of either of one or a combination of released timing that the weft at any given rolled strips is released. As any given rolled strips, for example, so-called "last released timing" can be used that the weft of the final roll has been released.

As the arrival timing, it can be either of one or a combination of so-called "last arrival timing" that the weft arrives at a final position and so-called "intermediate arrival timing" that the weft arrives at a predetermined position between the measuring reservoir apparatus and the final position.

As the parameter, it can be either one or a combination of at least two selected from a main pressure, a subpressure, timing of a fluid ejection from a main nozzle, a fluid ejection period from the main nozzle, timing of a fluid ejection from a subnozzle, a fluid ejection period from the subnozzle and timing when the weft begins to be released and withdrawn from the measuring reservoir apparatus.

As the actuator which is an actual control object, it can be a regulator for the main pressure, a regulator for the subpressure, a valve for switching a fluid passage to the main nozzle and a valve for switching a fluid passage to the subnozzle, depending on the parameters.

BRIEF DESCRIPTION OF THE DRAWINGS

The foregoing and other objects and features of the invention will become apparent from the following description of preferred embodiments of the invention with reference to the accompanying drawings, in which:

FIG. 3 is a view showing an embodiment of fuzzy control rules used in the fuzzy inference;

FIG. 6 is a view combined with FIG. 5 and explaining the fuzzy inference;

FIG. 9 is a partial view showing fuzzy control rules used in another fuzzy inference together with the membership functions of FIG. 8;

FIG. 10 is a schematic view showing another partial portion of the fuzzy control rules used in another fuzzy inference together with the membership functions of FIG. 8; and FIG. 11 is a schematic view showing the remaining portion of the fuzzy control rules used in another fuzzy inference together with the membership functions of FIG. 8.

DETAILED DESCRIPTION OF THE PREFERRED EMBODIMENTS

Figure 1:
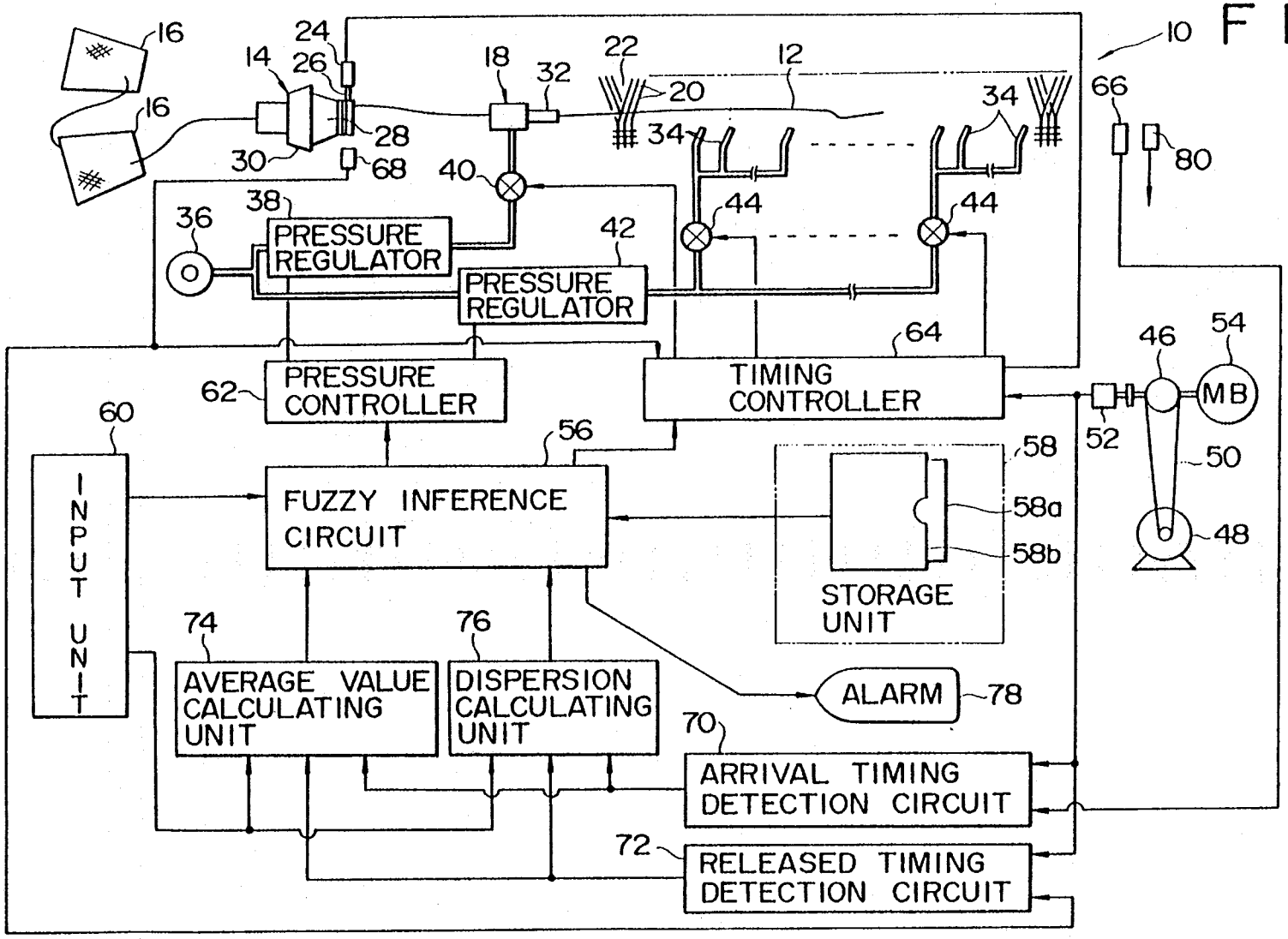
FIG. 1 is a schematic view showing an embodiment of a weaving machine equipped with a control device according to the present invention.

Referring now to FIG. 1, a weaving machine 10 is an air type jet loom and includes a drum-type measuring reservoir apparatus 14 for a weft 12.

The weft 12 is supplied to a known weft inserting apparatus 18 from weft packages 16 through the measuring reservoir apparatus 14 and inserted into a shedding 22 of warps 20 from the weft inserting apparatus.

At the time of measurement, the release of the weft 12 from the drum 28 both for measuring and reserving is prevented by an engagement pin 26 whose top end is operated by an electromagnetic solenoid 24, and the weft 12 is wound on the external surface of the drum 28 in a predetermined length by the rotation of a yarn guide and reserved.

On the other hand, at the time of weft inserting, the weft 12 is released from the drum 28 through the disengagement of the pin 26, and ejected from a main nozzle 32 of the weft inserting apparatus 18 together with a pressured air so as to be entered the shedding 22 of the warps 20 and be cut. Then, the weft inserting apparatus 18 includes a plurality of subnozzles 34 for ejecting the pressured air which proceeds the weft 12 in a predetermined direction at the time of weft inserting.

The pressured air of a pressure source 36 is supplied to the main nozzle 32 through a pressure regulator 38 and a switching valve 40. Similarly, the pressured air of the pressure source 36 is supplied to each subnozzle 34 through a pressure regulator 42 and the corresponded switching valves 44.

The weaving machine 10 also includes a motor 48 for a main shaft 46 for driving a reed. The rotation of the motor 48 is transmitted to the main shaft 46 through a connecting mechanism 50. Both of an encoder 52 for generating a rotating angle signal corresponding to the rotating angle of the main shaft 46 and an electromagnetic brake 54 for the main shaft 46 are connected to the main shaft 46. Both of the measuring reservoir apparatus 14 and the weft inserting apparatus 18 are driven in synchronism with the rotation of the main shaft together with the reed and healds or the like.

A weft inserting control device for the weaving machine 10 includes a fuzzy inference circuit 56 for making a fuzzy inference for a corrected value of a weft inserting parameter using at least one operating information relating to the weft inserting of the weaving machine, a plurality of membership functions and a plurality of fuzzy control rules.

Weft running information representing a weft running condition, weaving machine stop information representing a weaving machine stop condition and fabric quality information representing a fabric quality condition or the like can be used as the operating information. It is preferable that the weft running information is such running data as the weft running timing.

Hereinafter will be described an embodiment for making a fuzzy inference of an actual corrected value by using the average value and dispersion of the weft running timing as the operating information.

As the weft running timing for fuzzy inference, for example, use is made of either one or a combination of at least two selected from;

a: so-called "last released timing" such as the rotating angle (the last released angle) of the main shaft when the last roll of the weft 12 finishes to be released from the measuring reservoir apparatus, b: so-called "last arrival timing" such as the rotating angle (the last arrival angle) of the main shaft when the leading end of the weft 12 arrives at the final position, and c: so-called "intermediate arrival timing" such as the rotating angle (the intermediate arrival angle) of the main shaft when the leading end of the weft 12 arrives at a predetermined position between the measuring reservoir apparatus and the final position.

The last released timing and the last arrival timing are used as the weft running timing in the following explanation.

As a specific value of the weft running timing for fuzzy inference, for example, use is made of either one or a combination of at least two selected from:

a: the average value itself of the weft running timing, b: the difference between the average value of the weft running timing and its objective value, that is, average value error, c: the average value itself of the maximum or minimum value of the weft running timing, and d: the difference between the average value of the maximum or minimum value of the weft running timing and its objective value.

The average value itself of the weft running timing is used as a specific value p of the average value of the weft running timing in the following explanation.

A specific value of the dispersion of the weft running timing for fuzzy inference, for example, use is made of either one or a combination of at least two selected from:

a: the dispersion itself of the weft running timing, b: the difference between the dispersion of the weft running timing and its objective value, that is, dispersion error, c: the dispersion itself of the maximum or minimum value of the weft running timing, and d: the difference between the dispersion of the maximum or minimum value of the weft running timing and its objective value.

The dispersion itself of the weft running timing is used as a specific value G of the dispersion of the weft running timing in the following explanation.

As the parameter for controlling the weft running timing to an objective value, for example, use is made of either one or a combination of at least two selected from:

a: the main pressure, b: the subpressure, c: the start timing of air ejection from the main nozzle, d: the end timing of air ejection from the main nozzle, e: the start timing of air ejection from the subnozzle, f: the end timing of air ejection from the subnozzle, g: the start timing of release of the weft by the measuring reservoir apparatus, h: the end timing of release of the weft by the measuring reservoir apparatus, and i: the start time of weft inserting, that is, a start time of picking of the weft.

Here, the start time of weft inserting means a time determined by both of the start timing of air ejection from the main nozzle and the start timing of release of the weft by the measuring reservoir apparatus, and is a parameter used when the weft inserting start time is always set to be varied by the interlocking of both timings.

The main pressure and the subpressure are used as a parameter P in the following explanation.

The control device for weft inserting comprises a storage unit 58 for storing a plurality of membership functions shown in FIG. 2 and a plurality of fuzzy control rules shown in FIG. 3, which are used for a fuzzy inference in the fuzzy inference circuit 56, an input unit 60 for setting various information, a pressure controller 62 for controlling the pressure regulators 38 and 42 on the basis of the signals supplied from the fuzzy inference circuit 56, and a timing controller 64 for operating the switching valves 40 and 44 and the electromagnetic solenoid 24 on the basis of the signals supplied from the fuzzy inference circuit 56.

Figure 2A:
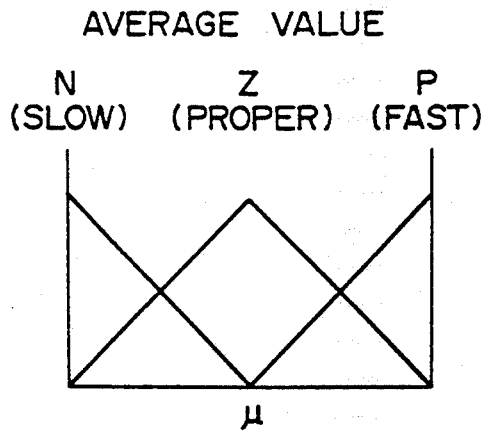
FIGS. 2(A), 2(B) and 2(C) are schematic views showing an embodiment of membership functions used in a fuzzy inference.

As shown in FIGS. 2(A), (B) and (C), the membership functions used for the fuzzy inference are stored in the storage unit 58 every average value $\mu$, dispersion $\sigma$ and air pressure.

The membership functions P, Z and N shown in FIG. 2(A) correspond to the languages that the average values $\mu$ are "fast", "approximately proper" and "slow", respectively, and express an apparent certainty that the average value $\mu$ belongs to the corresponding language set.

Figure 2B:
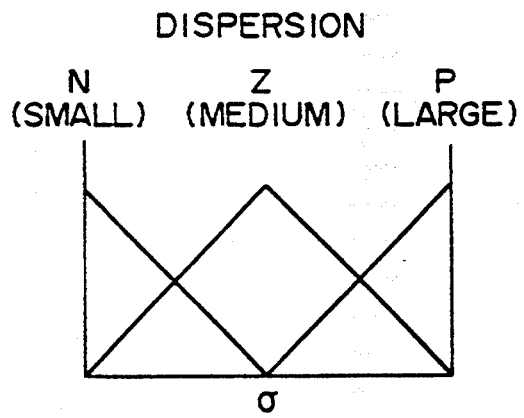

The membership functions P, Z and N shown in FIG. 2(B) correspond to the languages that the dispersions $\sigma$ are "large", "neither large nor small" and "small", respectively, and express an apparent certainty that the dispersion G belongs to the corresponding language set.

The membership functions shown in FIGS. 2(A) and 2(B) are used for the inference of how much the average value $\mu$ and the dispersion $\sigma$ agree with the antecedent portion of the fuzzy control rule, that is, the inference of a degree of matching.

The membership functions shown in FIGS. 2(A) and 2(B) are used both for the last released timing and the last arrival timing in common. However, the membership function every the last released timing and the last arrival timing may be also used.

Figure 2C:
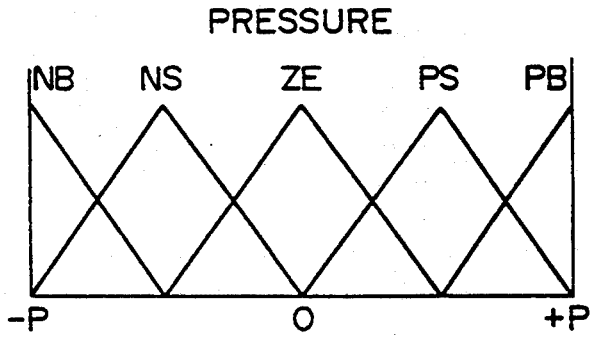

The membership functions PB, PS, ZE, NS and NB shown in FIG. 2(C) correspond to the languages of "increase largely" "increase a little", "hardly change", "decrease a little" and "decrease largely" the air pressure for weft inserting and express an apparent certainty that the parameters belong to the corresponding language set. In addition, these membership functions PB, PS, ZE, NS and NB are used when the consequent portion of the fuzzy control rule is inferred on the basis of the above-mentioned degree of matching.

The membership functions PB, PS, ZE, NS and NB shown in FIG. 2(C) are used in common both for the main pressure and the subpressure which are the parameters. However, the membership functions every the main pressure and the subpressure may be used as well.

Such a memory circuit as an IC memory can be used as the storage unit 58. It is preferable, however, that use is made of a card-type IC memory capable of writing and reading information, that is, a memory 58*a*, and a write-and-read mechanism 58*b* for writing and reading the information for the memory card. By use of the memory card 58*a* and the write-and-read mechanism 58*b*, the fuzzy control rules and the membership functions used for the fuzzy inference can be easily corrected or varied.

To the input unit 60, a weft inserting frequency k is set which is used when the average value and dispersion of the last arrival timing and the average value and dispersion of the released timing are calculated. In addition, other parameters such as a starting time of picking, an initial air pressure and an initial set value of an ejection period or the like are preliminarily set to the input unit 60. However, these other parameters may be set so as to be inputted from the memory unit 58 to the fuzzy inference circuit 56.

The pressure controller 62 controls the pressure regulators 38 and 42 so that a pressure of air ejected from the main nozzle 32 and that ejected from the subnozzle 34 may become the values supplied from the fuzzy inference circuit 56. On the other hand, the timing controller 64 operates the switching valves 40 and 44 and the electromagnetic solenoid 24 so that the air ejection period and the operation starting time of the electromagnetic solenoid 24 may become the values supplied from the fuzzy inference circuit 56.

The weft inserting control device further comprises a first detector 66 for detecting that the weft 12 is inserted up to the final position, and a second detector 68 for detecting the release of weft wound on the drum, having a function for counting number of the released weft rolls, and for detecting that the final weft roll of the weft roll number per one pick has been released. As for the first and second detectors 66 and 68, a photo sensor utilizing a photoelectric transducer can be used.

The output signal of the first detector 66 is supplied to a detection circuit 70 for detecting the last arrival timing of the weft 12. On the other hand, the output signal from the second detector 68 is supplied both to a detection circuit 72 for detecting the last released timing of the weft 12 and to the timing controller 64.

The detection circuit 70 detects the rotating angle of the main shaft 46 when the leading end of the weft 12 arrives at the position of the first detector 66 as a value representing the last arrival timing every weft inserting, on the basis of the rotating angle signal supplied from the encoder 52 and the output signal of the first detector 66, and outputs the last arrival timing thus detected to two calculating units 74 and 76.

The detection circuit 72 detects the rotating angle of the main shaft 46 when the last weft roll has been released as a value representing the last released timing every weft inserting, on the basis of the rotating angle signal supplied from the encoder 52 and the output signal of the second detector 68, and outputs the last released timing thus detected to two calculating units 74 and 76.

The last arrival timing and the last released timing can be the rotating angle itself of the main shaft 46 when the output signals from the corresponding detectors 66 and 68 are supplied to the corresponding detection circuits 70 and 72, respectively.

The calculating unit 74 is an average value calculating unit for calculating the average value of the last arrival timing between the weft inserting frequencies k supplied from the input unit 60 and the average value of the last released timing, and both of the calculated average values are supplied to the fuzzy inference circuit 55. In addition, the average value can use the statistics such as a center value, a last value, a maximum value and a minimum value, instead of the preceding average values.

On the other hand, the calculating unit 76 is a dispersion calculating unit for calculating the dispersion of the last arrival timing between the weft inserting frequencies k supplied from the input unit 60 and the dispersion of the last released timing, and both of the calculated dispersions are supplied to the fuzzy inference circuit 55. The size of the dispersion is quantitatively expressed by variance, standard deviation and range which are known in statistics.

FIG. 3 shows a preferred embodiment of a fuzzy control rule for controlling a pressure of a weft inserting fluid (in this embodiment, main pressure and subpressure) using the average value itself and dispersion itself of weft running timing (in this embodiment, the last released timing and the last arrival timing).

In FIG. 3, a released average, a released dispersion, an arrival average and an arrival dispersion mean the average value of the last released timing, the dispersion of the last released timing, the average value of the last arrival timing and the dispersion of the last arrival timing, respectively. The upper columns and the lower columns show that the control object, that is, parameters are the main pressure and the subpressure, respectively.

FIG. 3 shows only one embodiment of fuzzy control rules R1 through R23. However, other fuzzy control rules corresponding to the blank positions in FIG. 3 may be used.

Each of the fuzzy control rules R1 through R23 has the following meanings.

R1: if the average value of the last arrival timing is slow (N), then increase the main pressure a little (PS) and increase the subpressure a little (Ps).

R2: if the dispersion of the last released timing is large (P), then increase the main pressure a little (PS).

R3: if the dispersion of the last released timing is small (N) and the average value of the last arrival timing is fast (P), then decrease the main pressure a little (NS),

R4: if the dispersion of the last arrival timing is large (P) and the average value of the last arrival timing is slow (N), then increase the main pressure largely (PB) and increase the subpressure largely (PB).

R5: if the dispersion of the last arrival timing is large (P) and the average value of the last arrival timing is fast (P), then increase the subpressure a little (PS) without mostly changing the main pressure (ZE).

R6: if the dispersion of the last arrival timing is small (N) and the average value of the last arrival timing is slow (N), then increase the main pressure a little (PS) and increase the subpressure a little (PS).

R7: if the dispersion of the last arrival timing is small (N) and the average value of the last arrival timing is fast (P), then decrease the main pressure largely (NB).

R8: if the dispersion of the last released timing is large (P) and the average value of the last released timing is slow (N), then increase the main pressure a little (PS).

R9: if the dispersion of the last released timing is large (P) and the average value of the last released timing is neither fast nor slow (Z), then increase the main pressure a little (PS).

R10: if the dispersion of the last released timing is large (P) and the average value of the last released timing is fast (N), then increase the main pressure a little (PS).

R11: if the dispersion of the last released timing is small (N) and the average value of the last released timing is slow (N), then increase the main pressure a little (PS).

R12: if the dispersion of the last released timing is small (N) and the average value of the last released timing is fast (P), then decrease the main pressure a little (NS).

R13: if the average value of the last arrival timing is slow (N) and the average value of the last released timing is slow (N), then increase the main pressure largely (PB) and hardly change the subpressure (ZE).

R14: if the average value of the last arrival timing is slow (N) and the average value of the last released timing is neither fast nor slow (Z), then hardly change the main pressure (ZE).

R15: if the average value of the last arrival timing is fast (P) and the average value of the last released timing is slow (N), then increase the main pressure a little (PS) and decrease the subpressure largely (ZB).

R16: if the average value of the last arrival timing is fast (P) and the average value of the last released timing is neither fast nor slow (Z), then decrease the main pressure largely (NB).

R17: if the average value of the last arrival timing is slow (N) and the average value of the last released timing is fast (P), then increase the subpressure largely (PB).

R18: if the dispersion of the last arrival timing is large (P) and the dispersion of the last released timing is small (N), then increase the subpressure largely (PB).

R19: if the average value of the last arrival timing is neither fast nor slow (Z), then hardly change the subpressure (ZE).

R20: if the average value of the last arrival timing is fast (P), then decrease the subpressure a little (Ps).

R21: if the dispersion of the last arrival timing is large (P), then increase the subpressure a little (Ps).

R22: if the dispersion of the last arrival timing is neither large nor small (Z), then hardly change the subpressure (ZE).

R23: if the dispersion of the last arrival timing is small (N), then decrease the subpressure a little (NS).

Figure 4:
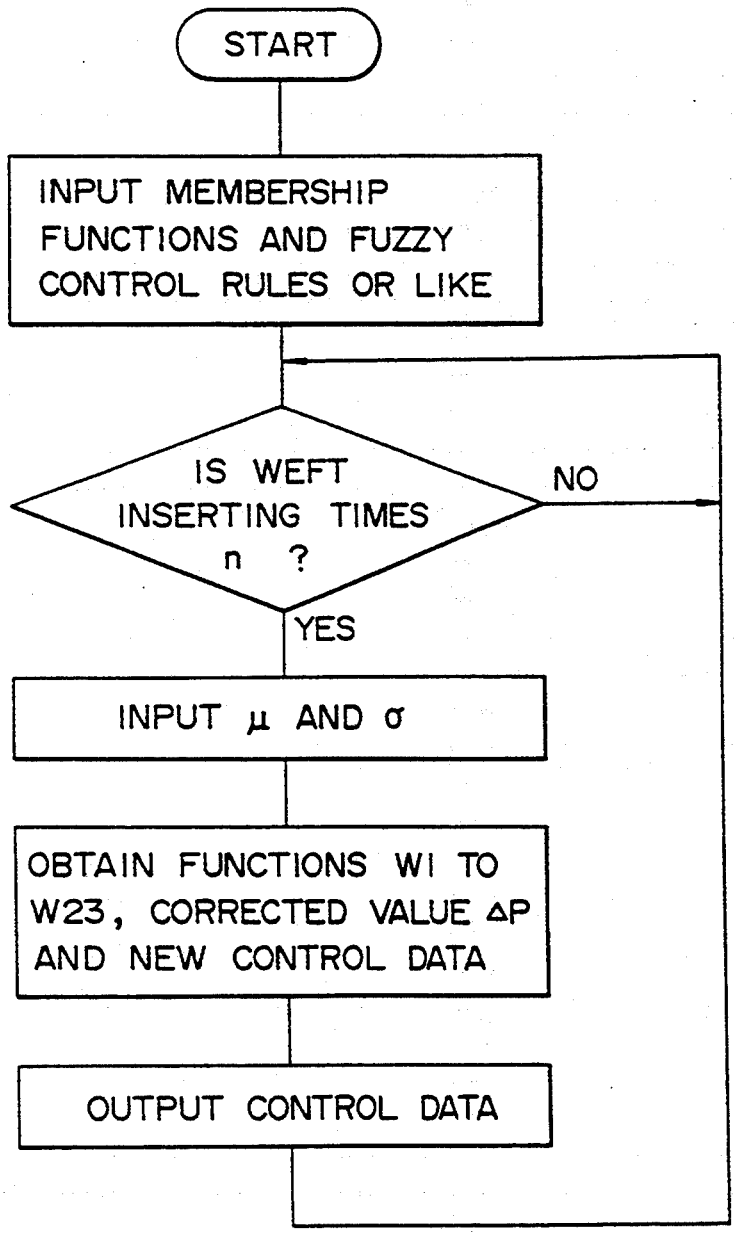
FIG. 4 is a flow chart of a fuzzy inference circuit.

Referring now to FIG. 4, a control method of weft inserting will be described.

The fuzzy inference circuit 56 receives various information outputted from the input unit 60, various membership functions shown in FIG. 2 and stored in the storage unit 58 and the fuzzy control rules R1 through R23 stored in the storage unit 58 by the input of a control start command.

Then, the fuzzy inference circuit 56 receives both average values outputted from the calculating unit 74 and both dispersions outputted from the calculating unit 76 when the weft inserting frequency reaches a predetermined value n. Thereafter, the fuzzy inference circuit 56 calculates the coincident ratios of the average value and dispersion of weft running timing to the antecedent portion of each of the fuzzy control rules R1 through R23, that is, the degree of matching W1 through W23 are obtained every the fuzzy control rules R1 through R23 on the basis of various inputted data.

Subsequently, the fuzzy inference circuit 56 obtains the consequent portion of each of the fuzzy control rules R1 through R23, that is, the functions u1 through u23 every the fuzzy control rules R1 through R23 on the basis of the obtained degree of matching w1 through w23 and the membership functions shown in FIG. 2(C).

Figure 5:
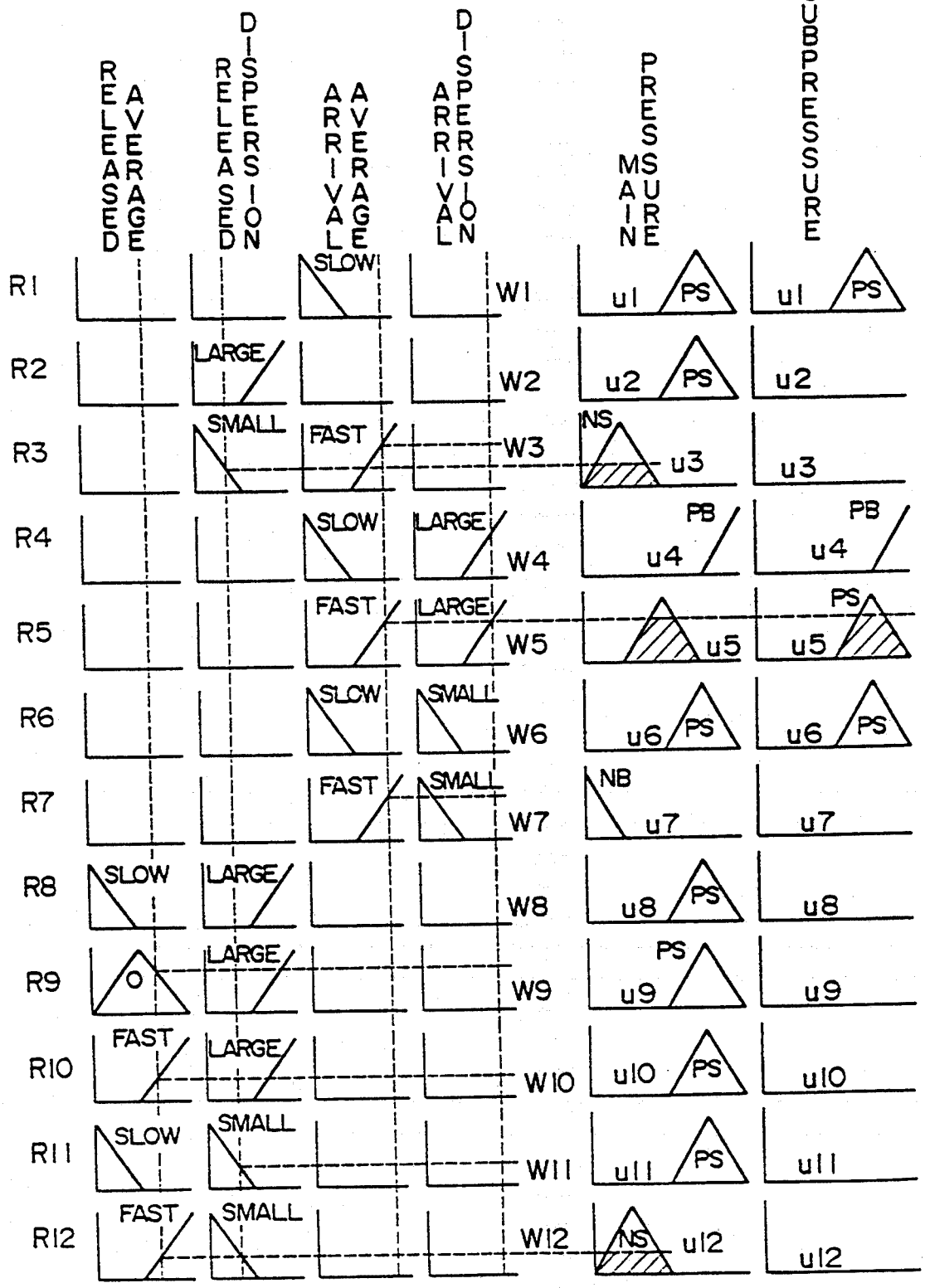
FIG. 5 is a view for explaining the fuzzy inference.

Each degree of matching w1 through w23 and each function u1 through u23 are obtained as shown in FIGS. 5 and 6. Namely, a representative embodiment with reference to the fuzzy control rule R3 will be described.

First of all, as shown by R3 in FIG. 5, the fuzzy inference circuit 56 calculates the degree of matching of the dispersion of the last released timings and the average value of the last arrival timing to the membership functions (N) and (P) set in the antecedent portion corresponding to these dispersion and average values, respectively. The common part of each degree of matching, that is, the smallest degree of matching is defined as the degree of matching w3 corresponding to the antecedent portion of this fuzzy control rule R3.

After then, the fuzzy inference circuit 56 cuts (head-off) the membership function (NS) at the consequent portion of the fuzzy control rule R3 by the degree of matching w3 thus obtained and calculates the minimum value (this is a common part and shown by dashed line in the figure) between the obtained degree of matching w3 and the membership function (NS). In this manner, the function u3 in the fuzzy control rule R3 is inferred.

Likewise, the functions u1, u2 and u4 through u23 in other fuzzy control rules R1, R2 and R4 through R23 are also inferred. Furthermore, in case where the degree of matching w is zero, the corresponding functions u become zero as well.

By synthesizing the calculated functions u1 through u23 by overlapping as shown in R0 of FIG. 6, the fuzzy inference circuit 56 calculates the synthetic membership function of main pressure and of subpressure, that is, a fuzzy set S(m) and a fuzzy set S(s). Thereafter, the fuzzy inference circuit 56 calculates the value ΔP of the center of gravity in the fuzzy set with respect to the main pressure and the value ΔP of the center of gravity in the fuzzy set with respect to the subpressure.

The value ΔP of the center of gravity is a value on the horizontal axis which halves the area of the synthetic membership function, and the fuzzy inference circuit 56 makes this value to be a determined value of the overall inference result of the fuzzy control rules R1 through R23, that is, a corrected value ΔP which should increase and decrease the main pressure and a corrected value ΔP which should increase and decrease the subpressure.

Then, the fuzzy inference circuit 56 calculates new main pressure and subpressure by adding the corrected value thus obtained to the present main pressure and subpressure. The resulting new main pressure and subpressure become higher than the present picking pressure if the corrected value ΔP is positive, and they become lower than the present picking pressure if the corrected value ΔP is negative.

Subsequently, the fuzzy inference circuit 56 supplies the new main pressure and subpressure to the pressure controller 62 as the next main pressure and subpressure, and at the same time, a picking start time and an ejection period preliminarily set are supplied to the controller 62 and the timing controller 64.

Accordingly, the pressure controller 62 controls the pressure regulators 38 and 42, respectively, so as to give the pressure supplied from the fuzzy inference circuit 56, and the timing controller 64 controls the switching valves 40 and 44 and the electromagnetic solenoid 24 so as to become the picking start time and the ejection period supplied from the fuzzy inference circuit 56.

In addition, the following control rules can be added accordingly as their necessity.

R: if the dispersion of the last released timing is small (N), the average value of the last arrival timing is neither fast nor slow (Z), and the dispersion of the last arrival timing is large (P), then increase the subpressure a little (PS).

R: if the dispersion of the last released timing is small (N), the average value of the last arrival timing is neither fast nor slow (Z), and the dispersion of the last arrival timing is small (N), then decrease the subpressure a little (NS).

R: if the average value of the last arrival timing is fast (P) and the dispersion of the last released timing is large (P), then delay the start time for weft inserting a little (NS).

During weaving, a detection signal of the second detector 68 is used as a signal representing the timing for operating the pin 24 so as to hold the weft 12 to the pin 24 in the timing controller 64.

Other parameters such as the start time for picking and the ejection period supplied from the fuzzy inference circuit 56 to the pressure controller 62 and the timing controller 64 can be either an initial set value preliminarily set up to the input unit 60 or an initial set value inputted from the storage unit 58.

Instead of calculating the new main pressure and subpressure in the fuzzy inference circuit 56, the corrected value calculated in the fuzzy inference circuit 56 may be supplied to the pressure controller 62, and the resulting new main pressure and subpressure may be calculated in the pressure controller 64.

The preceding correction of main pressure and subpressure may be made using either the average value and dispersion of the weft running timing by the weft inserting repeated at k times in the past every each time of the weft inserting or the average value and dispersion of the weft running timing by the weft inserting repeated at k times in the past every certain times of n of the weft inserting. In this case, n may be equal to k.

The weft inserting is influenced by the quality of a reed in addition to the preceding various parameters or the quality of a weft (quality of a weft package). For this reason, the fuzzy inference circuit 56 makes the fuzzy inference of the quality of the reed and the quality of the weft using the weft running timing and the air pressure, that is, the fluid pressure, and the results are informed to an alarm device 78.

With reference to the quality fuzzy inference in the fuzzy inference circuit 56, a plurality of membership functions shown in FIG. 7 and a plurality of fuzzy control rules are stored in the storage unit 58. These membership functions and fuzzy control rules are read in the fuzzy inference circuit 56 at the start time of weaving or during weaving.

With respect to the quality inference in the fuzzy inference circuit 56, first of all, the subpressure as well as the dispersion or the average value of each weft running timing at different weft running positions located at the upper-stream position of the subnozzle can be used for the quality inference of the reed. In this case, it is preferable to take a relative ratio signal of the dispersion of the average value of each weft running timing at each weft running position on one side to that on the other side. The main pressure and the dispersion or the average value of the running timing between the measuring reservoir apparatus and the main nozzle can be also used for the quality inference of a weft.

Therefore, the dispersion of the last released timing, the ratio of dispersion (designated as "dispersion ratio" thereafter) of the last arrival timing to the dispersion of the last released timing, the main pressure and subpressure prior to their correction will be used in the quality inference in the fuzzy inference circuit 56 in the following description.

However, the ratio of the average value of the last arrival timing to the average value of the last released timing may be used instead of the dispersion ratio. Either of the main pressure or the subpressure may be used in accordance with the object of the quality inference, instead of using both of the main pressure and subpressure as well. Furthermore, the main pressure and subpressure after their correction may be used instead of the main pressure and subpressure prior to their correction.

Figure 7A:
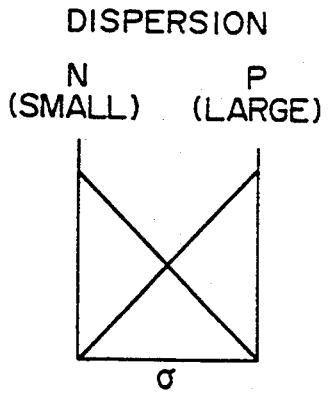
FIGS. 7(A), 7(B) and 7(C) are schematic views showing an embodiment of membership functions used in another fuzzy inference.

The membership functions P and N shown in FIG. 7(A) correspond to the dispersion of the last released timing and the dispersion ratio both in common. The membership functions P and N shown in FIG. 7(A) correspond to the languages that the dispersion and dispersion ratio are "large" and "small", respectively and express the apparent certainty that the dispersion and dispersion ratio belong to the corresponding language set.

Figure 7B:
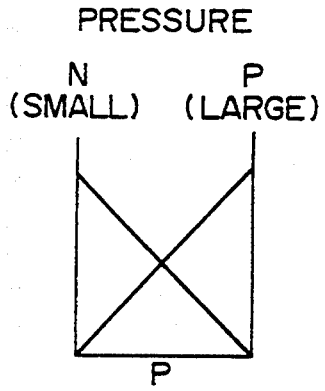

The membership functions P and N shown in FIG. 7(B) correspond to the main pressure and subpressure both in common. The membership functions P and N shown in FIG. 7(B) correspond to the languages that the inputted pressures P are "large" and "small", respectively, and express the apparent certainty that the pressures P belong to the corresponding language set.

The membership functions shown in FIGS. 7(A) and 7(B) are used for the inference how much the inputted dispersion $\sigma$ and the pressure P agree to the antecedent portion of each of the fuzzy control rules, respectively, which will be described later. The membership function in common for the dispersion, the dispersion ratio and the pressure P may be used instead of using a different membership function for the dispersion, the dispersion ratio, and the pressure P.

Figure 7C:
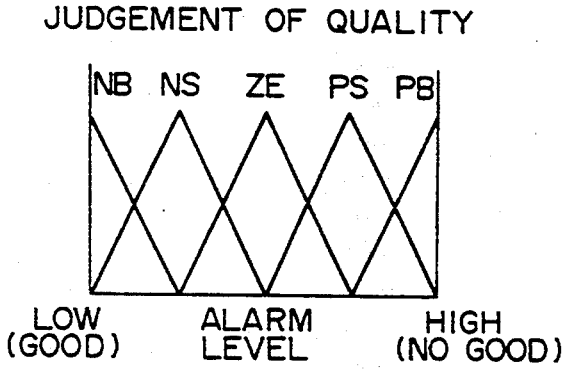

The membership functions PB, PS, ZE, NS and NB shown in FIG. 7(C) correspond to the languages that "increase largely", "increase a little", "hardly change", "decrease a little" and "decrease largely" with respect to an alarm level, and express the apparent certainty that the parameter (alarm level) belongs to the corresponding language set. These membership functions are used when the consequent portion of each of the fuzzy control rules which will be described later is inferred on the basis of the above-mentioned degree of matching.

As the fuzzy control rules to be used for the quality inference in the fuzzy inference circuit, the following will be able to be used. However, only the quality of the reed or only the quality of the weft may be inferred instead of inferring the quality of the reed and that of the weft.

R2·1: if the dispersion ratio is small (N), then judge that the reed is good and decrease the alarm level largely (NB).

R2·2: if the dispersion of the last released timing is small (N), the dispersion ratio is large (P) and the subpressure is large (P), then judge that the reed is no good since the subpressure is at its limit, and increase the alarm level largely (PB).

R2·3: if the dispersion of the last released timing is small (N), the dispersion ratio is large (P) and the subpressure is small (N), then judge that the reed is no good a little since there is room for increasing the subpressure, and increase the alarm level a little (PS).

R2·4: if the dispersion of the last released timing is large (P), the dispersion ratio is small (N) and the subpressure is small (N), then judge that the reed is neither good nor bad since there is room for increasing the subpressure, and do not change the alarm level (Z).

R2·5: if the dispersion of the last released timing is large (P), the dispersion ratio is large (P), the subpressure is small (N) and the main pressure is small (N), then judge that the reed is good a little since there is room for increasing the subpressure and the main pressure, and decrease the alarm level a little (NB).

R2·6: if the dispersion of the last released timing is large (P), the dispersion ratio is large (P) and the subpressure is large (P), then judge that the reed is no good a little since the subpressure is at its limit, and increase the alarm level a little (PS).

R2·10: if the dispersion of the last released timing is small (N), then judge that the weft is good, and decrease the alarm level largely (NB).

R2·11: if the dispersion of the last released timing is large (P) and the main pressure is small (N), then judge that the weft is no good a little since there is room for increasing the main pressure, and increase the alarm level a little (Ps).

R2·12: if the dispersion of the last released timing is large (P) and the main pressure is large (P), then judge that the weft is no good since the main pressure is at its limit, and increase the alarm level largely (PB).

The fuzzy inference using the fuzzy control rules R2·1 through R2·6 or R2·10 through R2·12 is carried out before, after or simultaneously with the fuzzy inference using the fuzzy control rules R1 through R23.

For this fuzzy inference, the fuzzy inference circuit 56 calculates the ratio of the dispersion of the last arrival timing to the dispersion of the last released timing and then obtains the fuzzy set for the quality of the reed and the fuzzy set for the quality of the weft using the fuzzy control rules R2·1 through R2·6 and R2·10 through R2·12 and the membership functions shown in FIG. 7.

Namely, in a similar manner to the case of using the fuzzy control rules R1 through R23, the fuzzy inference circuit 56, first of all, calculates the degree of matching of the dispersion of the last released timing and the degree of matching of the dispersion ratio with the antecedent portion of each of the fuzzy control rules, every each fuzzy control rule, then, calculates the consequent portion of each of the fuzzy control rules, that is, the function every each fuzzy control rule on the basis of the calculated degree of matching and the membership functions, and then obtains the fuzzy set for the quality of the reed and the fuzzy set for the quality of the weft by the synthesis by superposition of the obtained functions.

The fuzzy set thus obtained is supplied to the alarm device 78. The alarm device 78 is provided with a warning unit or a display unit, and accordingly, the supplied fuzzy set is informed to workers by a warning or a display.

The qualities of the reed and the weft can be informed to the workers by displaying their quality degrees in letters on the display unit. In case where either the reed or the weft is no good, it is preferable to inform to the workers by an alarm such as a buzzer.

The qualities of the reed and the weft may be informed only when the reed or the weft is no good. The qualities of the reed and the weft may be checked regardless of the fuzzy inference. Namely, the qualities of the reed and the weft may be evaluated by judging whether or not the dispersion of the last released timing, the dispersion ratio, the main pressure and the subpressure attain to their predetermined values, respectively.

The fuzzy inference circuit 56 further judges whether or not present value of the parameter such as the main pressure or the ejection timing reaches the limit value on the basis of the inferred corrected value. The fuzzy inference circuit stops any further corrections if the present value reaches the limit value. However, this function can be shared with the pressure controller 62 or the timing controller 64 as well.

The fuzzy inference circuit 56 infers the corrected values of both pressures and the corrected value of one of the main pressure and the subpressure in consideration of the balance between the main pressure and the subpressure, and a predetermined control signal is outputted to the pressure controller on the basis of the inferred corrected value.

The basic forms of the control rules for such fuzzy inferences can be done in the following.

R: if the main pressure is extremely high and the subpressure is low, then increase the main pressure a little and also increase the subpressure a little.

R: if the main pressure is low and the subpressure is extremely high, then increase the main pressure a little and also increase the subpressure a little.

In the present invention, the corrected value of at least one parameter is inferred by the fuzzy inference on the basis of the statistics such as the average value and dispersion of at least one weft running timing, and an actuator for weft inserting and corresponding to the parameter may be controlled on the basis of the inferred corrected value.

For this reason, for example, the weft running timing may be the last released timing or the last or intermediate arrival timing. The parameters may be only the main pressure or only the subpressure. In addition, the statistics may be at least one of the average value, the dispersion, the central value, the most frequent value, the maximum value and the minimum value.

The basic forms of the fuzzy control rules when the parameter is the main pressure can be done in the following.

R: if the dispersion is large, then increase the main pressure.

R: if the dispersion is small, then decrease the main pressure.

R: if the average value is large (when it is slow), then increase the main pressure.

R: if the average value is small (when it is fast), then decrease the main pressure.

In a similar manner, the basic forms when the parameter is the subpressure can be done in the following.

R: if the dispersion is large, then increase the subpressure.

R: if the dispersion is small, then decrease the subpressure.

R: if the average value is large (when it is slow), then increase the subpressure.

R: if the average value is small (when it is fast), then decrease the subpressure.

The weft running timing not only depends on the main pressure and the subpressure, but also depends on the above-mentioned various parameters.

For example, from the time when a picking air begins to be ejected from the main nozzle until the engagement pin is released and the weft running is started, so-called main precedent ejection period is short, and then, the initial pulling force is small. As a result, the running velocity is slow, and the frictional force of the engagement pin against the weft is small. Therefore, thread separation from the engagement pin is improved, and the dispersion becomes small. In an opposite case thereof, the running velocity becomes fast, and the resulting dispersion tends to become larger.

Therefore, the basic forms of the fuzzy control rules when the parameter is the timing for the ejection start of an air from the main nozzle can be done in the following.

R: if the dispersion is large, then delay the ejection start timing (reduce the main precedent ejection period).

R: if the dispersion is small, then advance the ejection start timing (increase the main precedent ejection period).

R: if the average value is large (when it is slow), then advance the ejection start timing (increase the main precedent ejection period).

R: if the average value is small (when it is fast), then delay the ejection start timing (reduce the main precedent ejection period).

From the similar reason, the basic forms of the fuzzy control rules when the parameter is the ejection start timing of an air from the subnozzle can be done in the following.

R: if the dispersion is large, then delay the ejection start timing (reduce sub precedent ejection period).

R: if the dispersion is small, then advance the ejection start timing (increase the sub precedent ejection period).

R: if the average value is large (when it is slow), then advance the ejection start timing (increase the sub precedent ejection period).

R: if the average value is small (when it is fast), then delay the ejection start timing (reduce the sub precedent ejection period).

Furthermore, the precedent ejection period is determined by the relative relation between the timing of the air ejection from the nozzle and the operating timing of the engagement pin. Therefore, the basic forms when the parameter is the operating timing of the engagement pin can be done in the following.

R: if the dispersion is large, then advance the operating timing of the engagement pin.

R: if the dispersion is small, then delay the operating timing of the engagement pin.

R: if the average value is large (when it is slow), then advance the operating timing of the engagement pin.

R: if the average value is small (when it is fast), then delay the operating timing of the engagement pin.

Furthermore, the weft inserting is also influenced by the kind of the weft 12. For example, in accordance with the kind of the weft 12, the weft inserting represents the following characteristics:

Filament yarn: The variation in the sizes of the weft package 16 correlates to the delay and advance of the arrival timing.

Acetates: In addition to the tendency of the above-mentioned filament yarn, acetates have a property to become loose when exposed to the air ejection. Thus, it is necessary to make the ejection period as shorter as possible (particularly in case of subnozzle).

Finished yarn: The tendency of the preceding filament yarn becomes loose every each weft package. Therefore, the control of the main pressure is effective.

Glass fiber yarn: The arrival timing suddenly changes. The released timing thereof makes largely loose. Thus, the control on the basis of the running data on the arrival side has no effect. It is necessary to control on the basis of the running data on the released side.

Therefore, it is necessary to alter the fuzzy control rules accordingly as the kind of the weft. For this purpose, a plurality of fuzzy control rules corresponding to the kind of the weft are set up for a plurality of wefts, and one kind of fuzzy control rule corresponding to the kind of the weft may be selected. Instead of this, the fuzzy control rule to be set is made only one kind, and other different control rules may be selected depending on the kind of the weft.

For example, with respect to the preceding fuzzy control rules R1 through R23, the following control rules can be deleted or added, depending on the kind of the wefts.

Filament yarn: Add a control rule "if the average value of the last arrival timing is extremely delayed, then increase the main pressure largely. (at the exchange of the weft package, this responds to the fact that the average value of the last arrival timing becomes very delayed.)

Acetates: The rules for controlling the timing of the air ejection start from the subnozzle and that of the air ejection termination are excluded.

Finished yarn: The control rules for controlling the subpressure are excluded.

Glass fiber yarn: The control rules including the dispersion of the last arrival timing are excluded.

The weaving machine stop information as the operation information are listed in the following.

a: so-called H1 stop on the basis of that the weft is not detected by the first detector 66.

b: so-called H2 stop on the basis of that the weft is detected by a third detector 80 in FIG. 1.

c: so-called loose stop on the basis of the loosing of the weft.

H1 stop happens, in general, when the weft does not arrive at the location of the first detector 66. The causes of H1 stop are due to tangle of its leading end, tie-up of its leading end, blown-off of its leading end, bent pick, warp hanger, measuring mistake, cutting mistake, blank pick and run-out or the like.

On the contrary, H2 stop happens when the wefts in excess runs. The causes of H2 stop are due to blown-off of its middle portion and measuring mistake or the like. Loose stop is caused by weft looseness and kinky thread. In addition, for example, a disclosed technique in Japanese Patent Disclosure (KOKAI) No. 63-92758 can be applied to looseness detection.

These information may be the number of times of stopping, the ratios of failures and the frequencies of failures or the like. However, they are preferably in the sizes thereof.

In case of using the weaving machine stop information as the operating information, the weft inserting control device is provided with a circuit for detecting H1 stop, H2 stop or loose stop and a circuit for calculating the stopping times, the dispersion of stopping times and the average value of stopping times on the basis of detection signals. However, the calculation of stopping times, the dispersion of stopping times and the average values of stopping times may be carried out in the fuzzy inference circuit as well. In addition, in case where there are no available suitable detectors for automatically detecting the detailed causes (tangle of its leading end, blown-off of its middle portion, kinky thread or the like) for H1 stop, H2 stop and loose stop, operators should check the causes and set in the input unit 60.

Furthermore, as for the weaving machine stop information, an operator's perceptive value may be set in the input unit 60. In this case, the weaving machine stop information can be set as any given numbers from "0" through "10". For example, a case where the corresponding information is small is defined as "0", a case where the corresponding information is neither large nor small is defined as 5 and a case where the corresponding information is large is defined as 10, respectively.

For the fabric quality information as the operating information, the following information are available.

a: generation of kinky thread b: generation of naps c: inspecting information

In case of using the fabric quality information as the operating information, the weft inserting control device is preferably provided with a circuit for generating the fabric quality information. However, the fabric quality information may be set in the input unit 60 as an operator's perceptive value, after the operator checks cloth.

In case of setting the fabric quality information as the operator's perceptive value, the fabric quality information can be set as any given numbers from "0" through "10". For example, a case where the product quality is good is defined as "0", a case where the product quality is neither good nor bad is defined as "5", and a case where the product quality is bad is defined as "10", respectively.

Figure 8A:
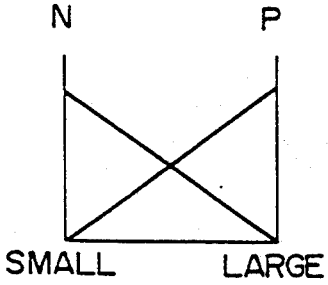
FIGS. 8(A ) and 8(B) are schematic views showing an embodiment of membership functions used in a further fuzzy inference.
Figure 8B:
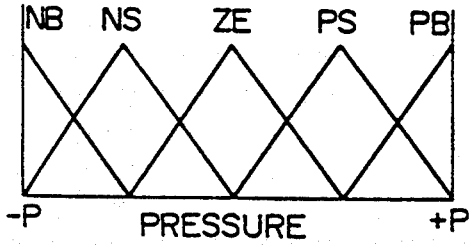

FIGS. 8 through 10 show a preferred embodiment of the fuzzy control rules when the main pressure and the subpressure are corrected using the weft running information, the weaving machine stop information, the weaving machine stop information and the fabric quality information. The fuzzy control rules R3·1 through R3·39 shown in FIGS. 8 through 10 are as follows: for example, FIGS. 8(A) and 8(B) show a preferred embodiment of the membership functions and FIGS. 9 through 11 show a preferred embodiment of the fuzzy control rules, respectively, in case of correcting the main pressure and the subpressure, using the weft running information, the weaving machine stop information and the fabric quality information.

The membership function shown in FIG. 8(A) can be used for each operating information in common. Furthermore, the membership functions P and N shown in FIG. 8(A) correspond to the languages such as "a lot", "large", "slow" or "bad", and the languages such as "a little", "small", "fast" or "good" in accordance with the kinds of the operating information, and express the apparent certainty that the operating information belongs to the corresponding language set.

The membership functions shown in FIG. 8(A) are used for the inference how exactly the corresponding operating information matches the antecedent portion of each of the fuzzy control rules R3 1 through R3 39. The membership function may be provided every each operating information.

The membership functions in FIG. 8(B) can be used for the main pressure and the subpressure in common. Furthermore, the membership functions PB, PS, ZE, NS and NB shown in FIG. 8(B) correspond to the languages that "increase", "increase a little", "not change", "decrease a little" and "decrease", respectively, with respect to the pressures and express the apparent certainty that the parameters (pressure) belong to the corresponding language set. The membership functions can be used when the consequent portion of each of the fuzzy control rules R3·1 through R3·39 is inferred on the basis of the above-mentioned degree of matching.

The fuzzy control rules R3·1 through R3·39 shown in FIGS. 9 through 11 can be read in, for example.

R3·7: if the weft looseness is a lot (P) and the tie of weft leading end is a lot (P), then increase the main pressure a little (PS) and also increase the subpressure (PB).

R3·25:if the kinky thread is a little (N) and the blown-off of its leading end is a lot (P), then decrease the main pressure (NB) and also decrease the subpressure a little (NS).

The membership functions shown in FIG. 8 and the fuzzy control rules shown in FIGS. 9 through 11 are all stored in the storage unit 58 and also read in the fuzzy inference circuit 56 at the start time of weaving or during weaving.

In case of using the fuzzy control rules R3·1 through R3·39, the fuzzy inference circuit 56, first of all, obtains the operating information corresponding to the antecedent portion of each of the fuzzy control rules every each fuzzy control rule in similar to the case of using the fuzzy control rules R1 through R23, and then, the consequent portion of each of the fuzzy control rules, that is, their functions are obtained every each fuzzy control rule and each pressure, on the basis of the obtained degree of matching and membership functions. After then, by the synthesis by superposing the obtained functions, the fuzzy set for the corrected quantity of the main pressure and the fuzzy set for the corrected quantity of the subpressure are obtained, and the corrected quantities thus obtained are outputted to the pressure controller 62.

What is claimed is:

1. A control device for weft inserting in a jet loom, comprising:

information generating means for detecting a last released timing and a last arrival timing of a weft to be inserted and generating the timing informations corresponding thereto; and control means for obtaining, on the basis of both said timing informations outputted from said information generating means, at least two pieces of operating information selected from a group consisting of the average value of the last released timing, the dispersion of the last released timing, the average value of the last arrival timing and the dispersion of the last arrival timing, and inferring by fuzzy inference a corrected value of either a main pressure or a subpressure for weft inserting so as to make the last arrival timing to be attained at an objective value on the basis of the obtained operating information, and then controlling said corresponding pressure on the basis of the inferred corrected value.

2. A control device for evaluating a reed in a jet loom, comprising:

information generating means for detecting a last released timing and a last arrival timing of a weft to be inserted and generating the timing informations corresponding thereto; and judging means for evaluating a reed by obtaining, on the basis of both said timing informations outputted from said information generating means, the extent of dispersion of the last released timing and the extent of dispersion of the last arrival timing, and then evaluating the reed on the basis of both said obtained extents.

3. A control device according to claim 2, wherein said judging means evaluate said reed on the basis of both said obtained extents and the subpressure for weft inserting.

4. A control device for weft inserting in a jet loom, comprising:

information generating means for detecting a last released timing and a last arrival timing of a weft to be inserted and generating the timing informations corresponding thereto; and control means for obtaining, on the basis of both said timing informations outputted from said information generating means, the extent of the last released timing and the extent of the last arrival timing, and, on the basis of both the obtained extents, inferring by fuzzy inference a corrected value of the precedent ejecting period for ejecting a fluid for weft inserting from a main nozzle prior to the weft inserting and then controlling said precedent ejecting period on the basis of the inferred corrected value.

5. A control device according to claim 4, wherein said control means controls said precedent ejection period by adjusting the timing of the start of ejection of said fluid.

6. A control device according to claim 4, wherein said control means controls said precedent ejecting period by adjusting the timing of the actuation of an engagement pin for weft inserting.

7. A control device for weft inserting in a jet loom, comprising:

control means for inferring by fuzzy inference corrected values of a main pressure for weft inserting and a subpressure so as to make the last arrival timing to be attained at an objective value on the basis of quality information of a fabric, stop information of a weaving machine, and running information of a weft, and means for controlling said main pressure and subpressure on the basis of both the inferred corrected values.

8. A control device according to claim 7, wherein said quality information of a fabric is one or more parameters selected from the group consisting of weft slack, kinky thread and nap.

9. A control device according to claim 7, wherein said stop information is one or more parameters selected from the group consisting of leading end tangle, leading end knot, blow-off at leading end and cut by constraint.

10. A control device according to claim 7, wherein said running condition is one or more parameters selected from the group consisting of an arrival timing, the standard deviation of the arrival timing and a releasing speed of a weft.

11. A control device for weft inserting in a jet loom, comprising:

control means for inferring by fuzzy inference corrected values of a main pressure and a subpressure for weft inserting so as to make the last arrival timing to be attained at an objective value on the basis of quality information of a fabric, stop information of a weaving machine, and running information of a weft, and then controlling said main pressure and subpressure on the basis of both the inferred corrected values; and means for inputting said quality information, said stop information and said running information to said control means.

* * * * *